US008419134B1

(12) United States Patent
Yuan

(10) Patent No.: US 8,419,134 B1
(45) Date of Patent: Apr. 16, 2013

(54) CHAIR WITH SLIDING PILLOW

(75) Inventor: Xiaofen Yuan, Carmel, IN (US)

(73) Assignee: Westfield Outdoor, Inc., Westfield, IN (US)

( * ) Notice: Subject to any disclaimer, the term of this patent is extended or adjusted under 35 U.S.C. 154(b) by 216 days.

(21) Appl. No.: 12/707,407

(22) Filed: Feb. 17, 2010

Related U.S. Application Data

(60) Provisional application No. 61/207,808, filed on Feb. 17, 2009.

(51) Int. Cl.
*A47C 7/36* (2006.01)

(52) U.S. Cl.
USPC ..... 297/410; 297/284.7

(58) Field of Classification Search ..... 297/410, 297/284.7, 353, 440.11, 80, 39; 5/640, 643
See application file for complete search history.

(56) References Cited

U.S. PATENT DOCUMENTS

| | | | | |
|---|---|---|---|---|
| 2,497,395 | A * | 2/1950 | Cramer, Sr. | 297/318 |
| 2,905,230 | A * | 9/1959 | Gabriel | 297/410 |
| 3,279,849 | A * | 10/1966 | Radke et al. | 297/284.5 |
| 4,711,492 | A * | 12/1987 | Asbjornsen et al. | 297/284.7 |
| 4,941,222 | A * | 7/1990 | Prager | 5/111 |
| 5,237,713 | A * | 8/1993 | Prager | 5/722 |
| 5,586,810 | A * | 12/1996 | Liu | 297/406 |
| 5,590,929 | A * | 1/1997 | Hamelin | 297/216.12 |
| 5,762,403 | A * | 6/1998 | Robinson | 297/440.11 |
| 5,897,167 | A * | 4/1999 | Keith | 297/397 |
| 6,082,820 | A * | 7/2000 | Jeng | 297/326 |
| 6,126,237 | A * | 10/2000 | Ritterhouse | 297/397 |
| 6,644,747 | B2 * | 11/2003 | Jones | 297/399 |
| 6,755,463 | B2 * | 6/2004 | Lardieri et al. | 297/35 |
| 7,185,948 | B2 * | 3/2007 | Liu | 297/30 |
| 7,237,848 | B1 * | 7/2007 | Story et al. | 297/485 |
| 7,641,283 | B2 * | 1/2010 | Rumack | 297/219.12 |
| 7,806,472 | B2 * | 10/2010 | Runk et al. | 297/219.12 |
| 2002/0158499 | A1 * | 10/2002 | Clough | 297/410 |

FOREIGN PATENT DOCUMENTS

| | | | |
|---|---|---|---|
| EP | 611536 | A1 * | 8/1994 |
| FR | 2556197 | A1 * | 6/1985 |

* cited by examiner

*Primary Examiner* — David Dunn
*Assistant Examiner* — David E Allred
(74) *Attorney, Agent, or Firm* — Faegre Baker Daniels LLP

(57) ABSTRACT

A folding chair is disclosed including a folding chair frame, support material, and a pillow that can move between raised and lowered positions relative to the folding chair frame.

19 Claims, 4 Drawing Sheets

CHAIR WITH SLIDING PILLOW

RELATED APPLICATIONS

This application claims priority to U.S. Provisional Patent Application Ser. No. 61/207,808, filed Feb. 17, 2009, titled "Chair with Sliding Pillow," to Xiaofen Yuan, the entire disclosure of which is expressly incorporated by reference herein.

BACKGROUND AND SUMMARY OF THE INVENTION

The present invention relates generally to chairs. More particularly, the present invention related to a chair having a frame and pillow that can move relative to the frame.

BRIEF DESCRIPTION OF THE DRAWINGS

The detailed description of the drawings particularly refers to the accompanying figures in which.

DETAILED DESCRIPTION OF ILLUSTRATIVE EMBODIMENTS

The embodiments disclosed below are not intended to be exhaustive or to limit the invention to the precise forms disclosed in the following detailed description. Rather, the embodiments are chosen and described so that others skilled in the art may utilize their teachings.

Figure 1:
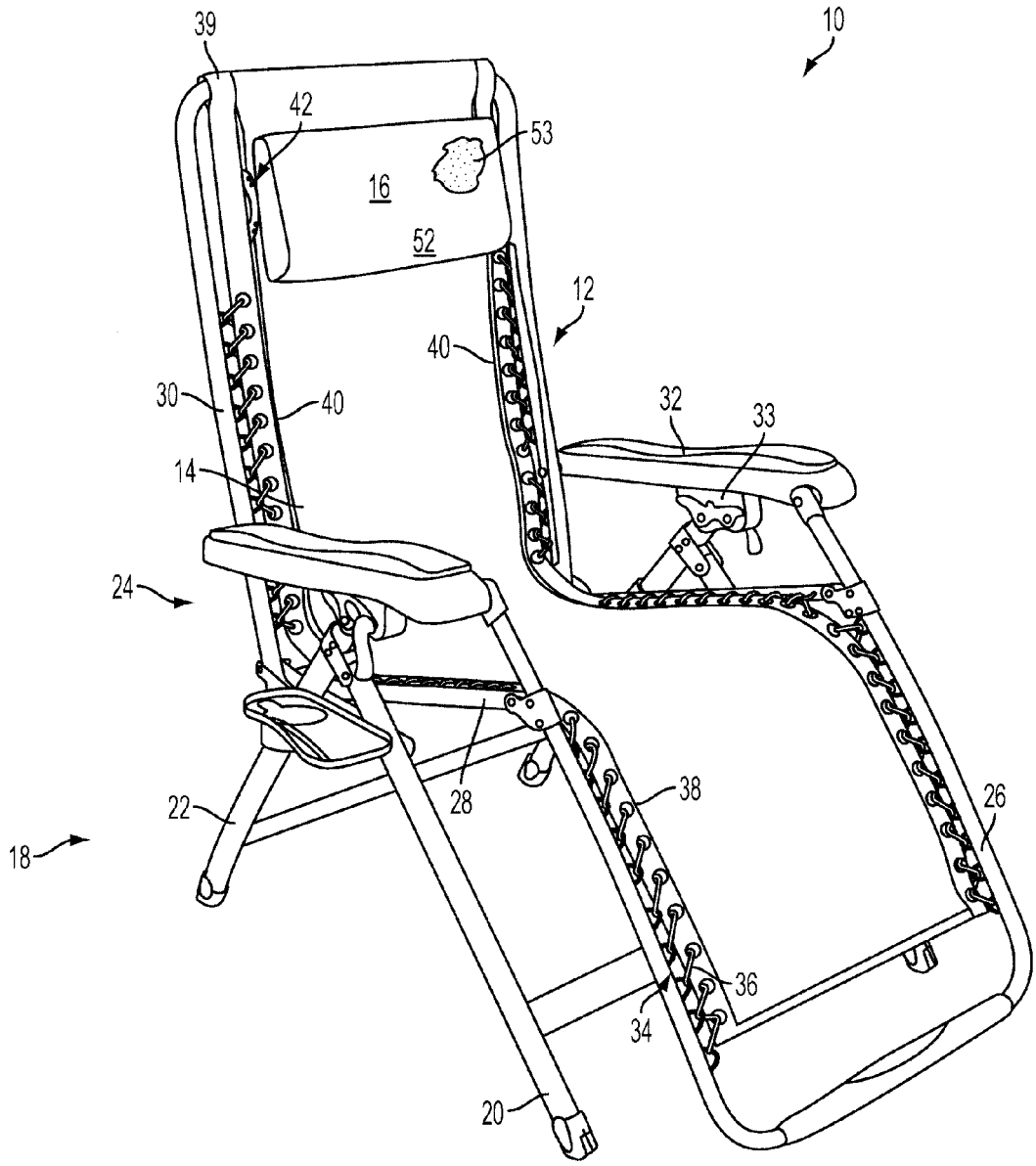
FIG. 1 is a perspective view of a chair showing the chair including a frame, support material coupled to the frame to support an occupant, and a pillow coupled to the support material by a pair of tracks to permit the pillow to be raised or lowered.

As shown in FIG. 1, reclining chair 10 is shown in an upright position. Chair 10 includes frame 12, support material 14 coupled to frame 12 to support an occupant, and pillow 16. An occupant can adjust the location of pillow 16 on support material 14 by moving pillow 16 up and down. This allows the occupant to position pillow 16 in a preferred location, such as behind their head or below the lumbar portion of their back.

In addition to adjusting the location of pillow 16, an occupant can adjust the configuration of chair to several positions. For example, as shown in FIG. 1, chair 12 is in an upright position. From the upright position, the occupant can move the chair to a relatively flat, laid-back position. Frame 12 includes base portion 18 including pair of legs 20, 22 and adjustable support portion 24 that allows frame 12 to move between the several positions. Base portion 20 rests on the ground during normal use to support adjustable support portion 24.

Adjustable support portion 24 includes leg section 26, seat section 28 pivotably coupled to leg section 26 and leg 22, back section 30 pivotably coupled to seat section 28, and arm section 32 pivotably coupled to back section 30 and leg section 26. Together, leg, seat, back, and arm sections 26, 28, 30, 32 cooperate to define a four-bar linkage that allows chair 12 to move between the chair position and the laid-back position. Arm sections 32 provide arm rests for the occupant and include latch 33 that locks the relative position of adjustable support portion 24 when it is not being adjusted.

Support material 14 is coupled to leg, seat, and back sections 26, 28, 30 by a plurality of loops 34 coupled to leg, seat, and back sections 26, 28, 30 and bungee cords 36 extending through loops 34 and apertures 38 provided in support material 14. According to alternative embodiments of the present disclosure, fasteners other than bungee cords 36 are provided to secure support material 14 to folding frame 12, such as snaps, rivets, or other fasteners known to those of ordinary skill in the art.

A top end of support material 14 includes loop 39 that receives a top bar of seat section 28. Support material is preferable made of nylon mesh material, but may be made of any material, such as other woven and non-woven materials.

Figure 2:
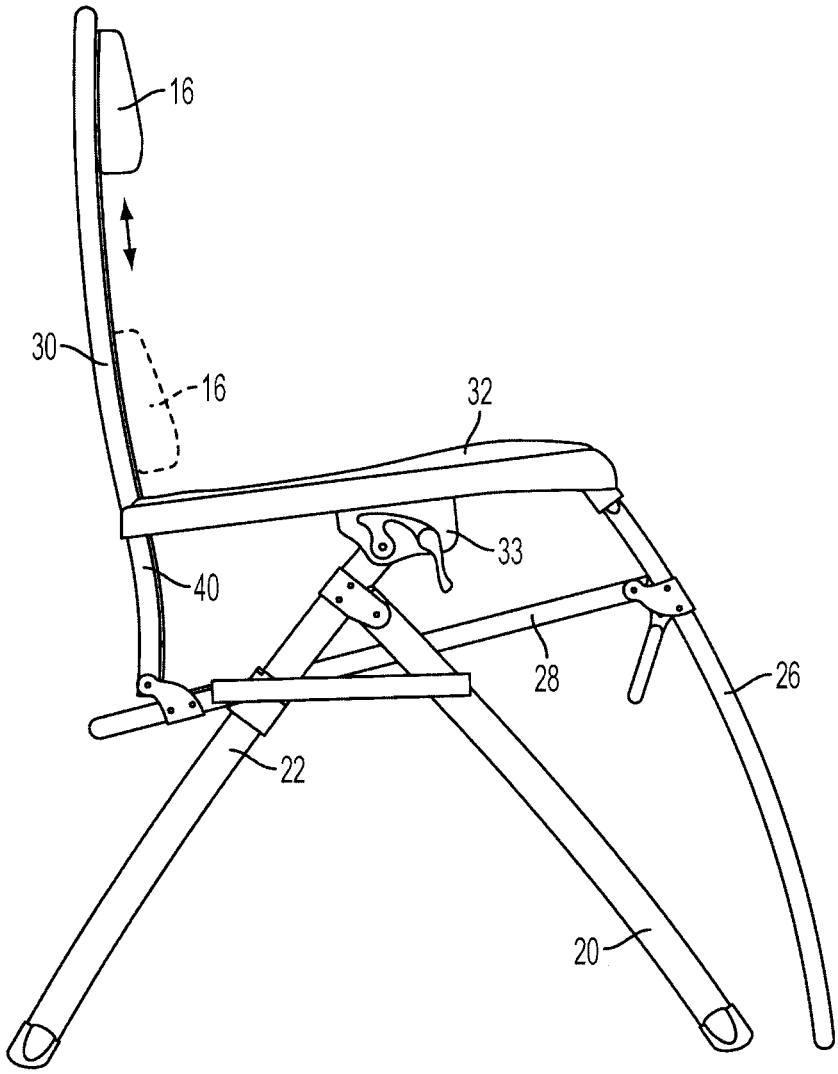
FIG. 2 is a side elevation view of the chair of FIG. 1 showing the pillow in a raised position in solid lines and a lowered position in phantom lines.
Figure 3:
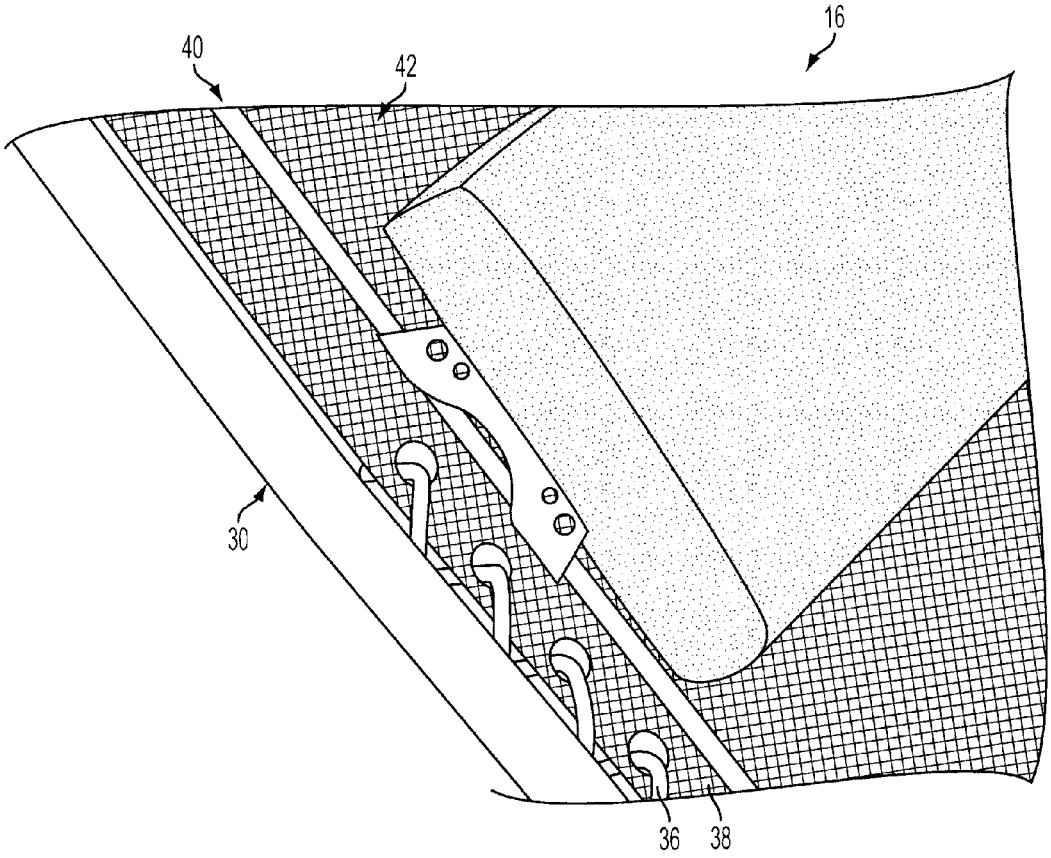
FIG. 3 is a perspective view of a portion of the chair of FIG. 1 showing the pillow coupled to the support material by the track and guide.
Figure 4:
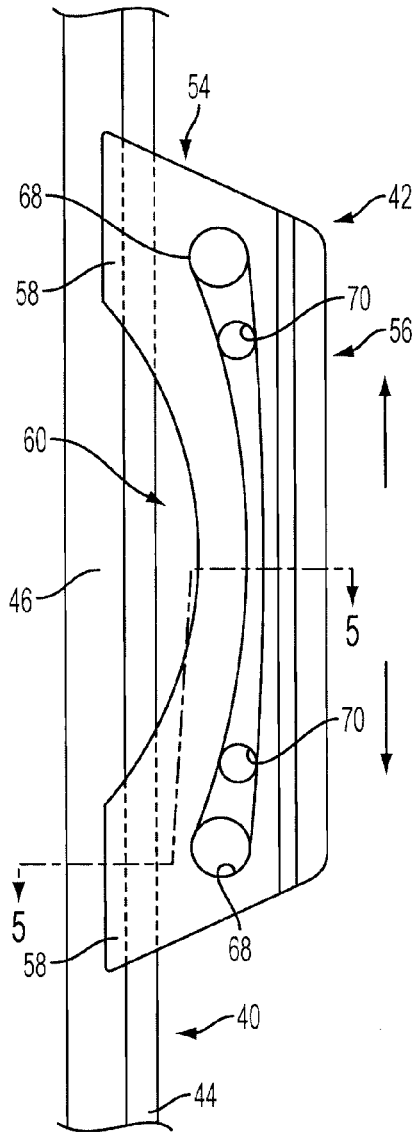
FIG. 4 is a side elevation view of the track and guide.
Figure 5:
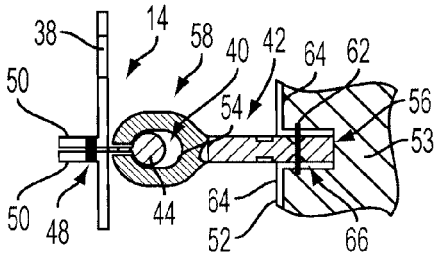
FIG. 5 is a cross-sectional view taken along line 5-5 of FIG. 4 showing a portion of the guide positioned over a portion of the track.

As shown in FIG. 2, the position of pillow 16 relative to back section 30 can be adjusted between a raised position (shown in solid lines) to a lowered position (shown in phantom lines). During adjustment, pillow 16 remains coupled to support material 14. According to the preferred embodiment of the present disclosure, pillow 16 is coupled to support material 14 by a pair of tracks 40 and a pair of guides 42 coupled to tracks 40 as shown in FIGS. 3-5.

As shown in FIG. 1, tracks 40 extend along back section 30 to permit pillow 16 to be moved from the top of back section 30 to the bottom of back section 30. Tracks 40 each include rail 44 that is substantially cylindrical and flange 46 that is substantially flat as shown in FIG. 5. Preferably, tracks 40 are made of extruded plastic to have a uniform cross-section along its length. Each track 40 is coupled to support material 14 with stitches 48 that extend through two edges 50 of support material 14 that define a slit and flange 46 as shown in FIG. 5.

Each guide 42 is coupled to tracks 40 and pillow 16 so that pillow 16 is coupled to support material 14. Pillow 16 includes cover 52 made of material similar to support material 14 and filling 53.

Each guide 42 is coupled to cover 52 of pillow 16. As shown in FIGS. 4 and 5, guide 42 includes channel 54 that receives rail 44 and flange 56 coupled to channel 54. Channel 54 is defined by two legs 58 extending from flange 56. As shown in FIG. 4, arched opening 60 is defined between legs 58. Flange 56 of each guide 42 is coupled to cover 52 of pillow 16 with stitches 62 that extending through two edges 64 of cover 52 and flange 56 as shown in FIG. 5. Stitches 62 extended through a portion 66 of flange 56 having a reduced thickness. Flange 56 also includes four apertures 68, 70 extending therethrough to reduce the amount of material in guide 42. As shown in FIG. 5, channel 54 has width slightly larger than the diameter of rail 44 and a height about 60-70% taller than the diameter of rail 44.

During adjustment of the position of pillow 16, an occupant aligns channels 54 with rails 44 to facilitate movement of pillow 16 along rails 44. When in the desired position, the occupant releases pillow 16. As a result, the weight of pillow 16 causes channels 54 of guides 42 to become misaligned with rails 44 causing guides 42 to bind with rails 44. This binding holds pillow 16 in the desired position until the occupant again aligns channels 54 and rails 44. In one embodiment, lower ends of rails 44 are open or unblocked so that pillow 16 can be removed for cleaning, repair, or otherwise. In this embodiment, upper ends of rails 44 are blocked with a cap, stitching, or otherwise to prevent inadvertent removal of pillow 16 during upward adjustment. In other embodiments, either or both ends of rails 44 may be open to permit removal of pillow 16 or blocked to prevent removal of pillow 16.

Although tracks 40, guides 42, and pillow 16 are shown in use with reclining chair 10, they may be used with other types of furniture designed to support people, such as cots, arm and other chairs, benches, gliders, other types of outdoor, patio, or lawn furniture, etc. For example, tracks 40, guides 42, and pillow 16 may be provided at the head end or otherwise on a cot (such as the cots described in U.S. Pat. Nos. 3,965,502; 5,301,377; and 6,345,400), a chair (such as the chairs described in U.S. Pat. Nos. 6,644,731; 5,716,101; and 5,112,107), or other types of furniture designed to support people. The disclosures of the referenced patents are hereby incorporated by reference in their entirety.

Many of the features and sub-features described herein function partially or totally independently of each other. Thus, many features and sub-features are optional depending on the needs of the particular circumstances. Additionally, features and sub-features described herein with reference to a particular embodiment may also be provided on the other embodiments described herein.

What is claimed is:

1. A folding chair comprising:

a folding chair frame having leg, seat, and back sections, the back section having a width;

support material suspended from the folding chair frame to support the legs, seat, and back of an occupant of the chair;

a sliding pillow; and at least two tracks coupled to the sliding pillow and the support material, the tracks being separated by a distance less than the width of the back section of the folding chair frame, wherein the pillow includes at least two guides supported by the at least two tracks and the guides include oval-shaped channels and the tracks include substantially cylindrical rails received in the oval-shaped channels; wherein the oval-shaped channel comprises an opening that includes an oval in a cross sectional plane of the channel, and a major axis of the oval in the cross sectional plane is generally perpendicular to the width of the back section.

2. The folding chair of claim 1, wherein the support material includes a slit and a portion of at least one of the tracks is positioned in the slit.

3. The folding chair of claim 2, wherein the support material includes two edges defining the slit and the at least one track and the edges of the support material are sewn together.

4. The folding chair of claim 3, wherein the track sewn to the edges of the support material includes a flange and a rail having a width greater than the flange.

5. The folding chair of claim 1, wherein the back section of the folding chair frame has a height and the tracks have a length that is less than the height of the back section of the folding chair frame.

6. The folding chair of claim 1, wherein the guide includes a first leg and a second leg, the pillow includes a top and a bottom, the first leg is positioned closer to the top of the pillow than the second leg.

7. A folding chair comprising:

a folding chair frame having leg, seat, and back sections, support material suspended from the folding chair frame to support the legs, seat, and back of an occupant of the chair;

a sliding pillow;

a track supported by the support material and coupled to the sliding pillow to guide sliding of the pillow along the support material, and a guide including a guide flange coupled to the sliding pillow, the guide slidingly supported by the track, wherein the track includes a track flange coupled to the support material and the guide flange is coplanar with the track flange.

8. The folding chair of claim 7, further comprising another track supported by the support material and coupled to the sliding pillow to guide sliding of the pillow along the support material.

9. The folding chair of claim 8, wherein the support material has a width and the tracks are separated by a distance that is less than the width of the support material.

10. The folding chair of claim 8, wherein the pillow has a width and the tracks are separated by a distant substantially equal to the width of the pillow.

11. The folding chair of claim 7, wherein the support material includes a slit and a portion of the track flange is positioned in the slit.

12. The folding chair of claim 7, wherein the support material is secured to the folding frame by a plurality of fasteners positioned adjacent to the folding frame and the track is positioned between at least two of the fasteners.

13. The folding chair of claim 7, wherein the track flange is sewn to the support material.

14. The folding chair of claim 7, wherein the pillow has a width from a top of the pillow to a bottom of the pillow and the guide flange has a length that is less than half of the width of the pillow.

15. A folding chair comprising:

a folding chair frame having leg, seat, and back sections, support material suspended from the folding chair frame to support the legs, seat, and back of an occupant of the chair;

a sliding pillow; and a track guiding sliding of the pillow along the support material, the support material having a slit receiving the track, wherein the pillow includes a guide slidingly coupled to the track and positioned adjacent the slit and the guide includes an oval-shaped channel and a guide flange; wherein the oval-shaped channel comprises an opening that includes an oval in a cross sectional plane of the channel, and a major axis of the oval in the cross sectional plane is coplanar with the guide flange.

16. The folding chair of claim 15, wherein the support material includes a pair of edges defining the slit and the track is sewn to the edges of the support material.

17. The folding chair of claim 15, wherein the support material includes another slit, the slits are separated by a distance, and the back section of the folding frame has a width that is greater than the distance separating the slits.

18. The folding chair of claim 15, wherein the support material is secured to the folding frame by a plurality of fasteners positioned adjacent to the folding frame and the slit is positioned between at least two of the fasteners.

19. The folding chair of claim 15, wherein the pair of legs cooperate to define an opening positioned between the spaced apart locations.

* * * * *

UNITED STATES PATENT AND TRADEMARK OFFICE

CERTIFICATE OF CORRECTION

PATENT NO. : 8,419,134 B1
APPLICATION NO. : 12/707407
DATED : April 16, 2013
INVENTOR(S) : Xiaofen Yuan It is certified that error appears in the above-identified patent and that said Letters Patent is hereby corrected as shown below:

In the Claims:

In Claim 10, at column 4, line 18, the word distant should be distance.

Signed and Sealed this
Eighteenth Day of June, 2013

Teresa Stanek Rea
*Acting Director of the United States Patent and Trademark Office*